US009378904B2

(12) United States Patent
Yang et al.

(10) Patent No.: US 9,378,904 B2
(45) Date of Patent: Jun. 28, 2016

(54) CIRCUIT BREAKER AND HANDLE LOCKING DEVICE THEREOF

(71) Applicant: Siemens Aktiengesellschaft, Munich (DE)

(72) Inventors: Dong Yang, Suzhou (CN); Deng Ke Zhang, Suzhou (CN)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 104 days.

(21) Appl. No.: 14/260,507

(22) Filed: Apr. 24, 2014

(65) Prior Publication Data

US 2014/0318933 A1 Oct. 30, 2014

(30) Foreign Application Priority Data

Apr. 28, 2013 (CN) ..... 2013 1 0156472

(51) Int. Cl.
*H01H 3/20* (2006.01)
*H01H 9/20* (2006.01)
*H01H 9/28* (2006.01)

(52) U.S. Cl.
CPC ..... *H01H 9/20* (2013.01); *H01H 9/282* (2013.01); *H01H 2300/024* (2013.01)

(58) Field of Classification Search
CPC ..... H01H 2300/24; H01H 9/20; H01H 9/286; H01H 9/282; H01H 9/283; H01H 2300/024; H01H 9/287
USPC ..... 200/43.14, 43.15, 43.16, 43.19, 50.01; 70/203, 212
See application file for complete search history.

(56) References Cited

U.S. PATENT DOCUMENTS 4,260,861 A 4/1981 DiMarco
5,717,178 A * 2/1998 Turner ..... H01H 9/283 200/50.01
2013/0056336 A1 3/2013 Grüet al.
2014/0166448 A1* 6/2014 Krieger ..... H01H 9/282 200/43.15

FOREIGN PATENT DOCUMENTS

EP 2743948 A1 6/2014

OTHER PUBLICATIONS

Search Report for corresponding European patent application No. 14165406.1 dated Aug. 14, 2014.

* cited by examiner

*Primary Examiner* — Renee Luebke
*Assistant Examiner* — Ahmed Saeed
(74) *Attorney, Agent, or Firm* — Harness, Dickey & Pierce, P.L.C.

(57) ABSTRACT

Disclosed is a handle locking device, including a first frame, a first snap hook and a second frame. A second snap hook is provided on the first frame; the first snap hook is rotatably mounted on the first frame; the second frame is rotatably mounted on the first frame; a protruding portion is formed on the second frame; and the protruding portion can push the first snap hook towards the first frame. By having the first snap hook and second snap hook disposed asymmetrically on the first frame, accidental mounting of the "OFF" position of the handle locking device in the "ON" position of the circuit breaker during installation by an operator can be avoided. Moreover, since the protruding portion can push the first snap hook towards the first frame, forced deformation of the snap claw and second snap hook can be prevented.

16 Claims, 7 Drawing Sheets

CIRCUIT BREAKER AND HANDLE LOCKING DEVICE THEREOF

PRIORITY STATEMENT

The present application hereby claims priority under 35 U.S.C. §119 to Chinese patent application number CN 201310156472.1 filed Apr. 28, 2013, the entire contents of which are hereby incorporated herein by reference.

TECHNICAL FIELD

At least one embodiment of the present invention generally relates to the field of low-voltage electrical appliances, in particular to a circuit breaker and/or a handle locking device thereof.

BACKGROUND ART

Existing circuit breakers are powered on or off by opening or closing a handle thereof. When a circuit breaker is in use, in order to prevent careless misoperation of the circuit breaker, which would affect the current-passing state, or put at risk the lives of staff during maintenance work, with unforeseeable results, it seems especially important that the position of the handle be maintained so that misoperation does not occur. In the prior art, a handle locking device is generally used to lock the circuit breaker handle, so as to prevent misoperation. However, in the course of being used by a user, the handle locking device easily suffers deformation as a result of a force exerted upon it by the circuit breaker, and this affects the reliability of the handle locking device.

SUMMARY

At least one embodiment of the present invention is directed to a handle locking device which can prevent misoperation and is highly reliable. At least one embodiment of the intention of the present invention is also directed to a circuit breaker which uses the handle locking device.

At least one embodiment of the present invention is realized by providing a handle locking device comprising a first frame, a first snap hook and a second frame; a second snap hook is provided on the first frame; the first snap hook is rotatably mounted on the first frame; the second frame is rotatably mounted on the first frame and can fix the first snap hook to the first frame; a protruding portion is formed on the second frame; and the protruding portion can push the first snap hook towards the first frame.

At least one embodiment of the present invention also provides a circuit breaker, comprising a housing and a handle mounted in the housing; a first mounting portion and a second mounting portion are provided on the housing; the circuit breaker further comprises the handle locking device mentioned above; and the protruding portion limits the first snap hook and the second snap hook in the first mounting portion and the second mounting portion corresponding thereto, respectively.

The above description is merely an overview of embodiments of the present invention. In order to allow the technical aspects of the present invention to be understood more clearly, and to be implemented according to the content of this description, and in order make the above and other objects, features and advantages of the present invention clearer and easier to understand, preferred embodiments are specially presented below, and a detailed explanation provided with reference to the accompanying drawings.

DETAILED DESCRIPTION OF THE EXAMPLE EMBODIMENTS

Figure 1:
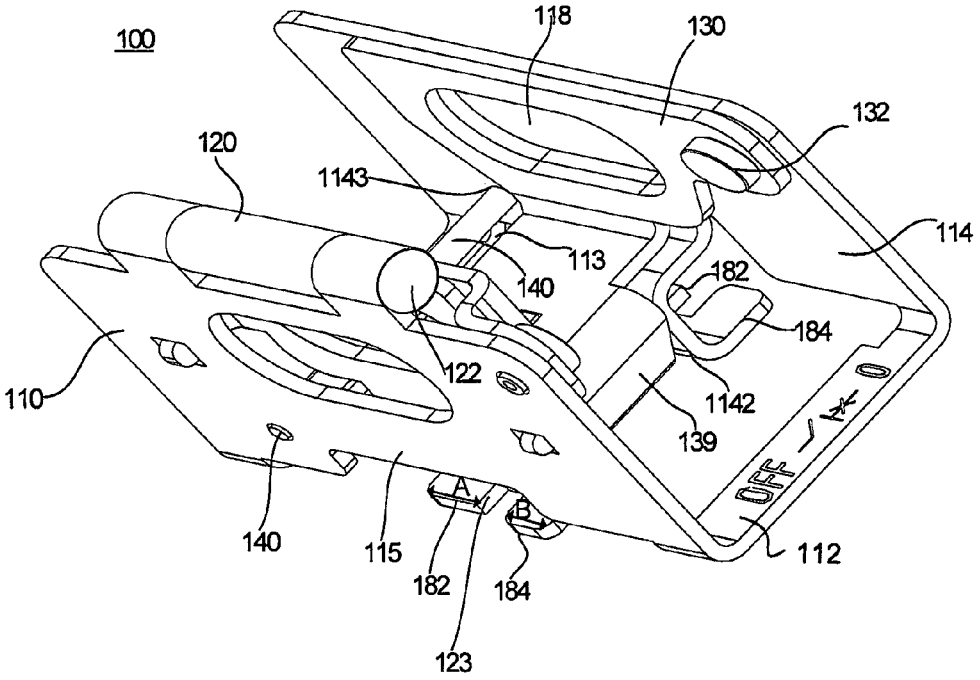
FIG. 1 is a schematic structural diagram of the handle locking device in an embodiment of the present invention.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

To clarify the technical problem which the present invention seeks to solve as well as the technical solution and beneficial effects thereof, the present invention is explained in further detail below with reference to embodiments and the accompanying drawings. It should be understood that the particular embodiments described here are intended merely to explain the present invention, not to define it.

At least one embodiment of the present invention is directed to a handle locking device which can prevent misoperation and is highly reliable. At least one embodiment of the intention of the present invention is also directed to a circuit breaker which uses the handle locking device.

At least one embodiment of the present invention is realized by providing a handle locking device comprising a first frame, a first snap hook and a second frame; a second snap hook is provided on the first frame; the first snap hook is rotatably mounted on the first frame; the second frame is rotatably mounted on the first frame and can fix the first snap hook to the first frame; a protruding portion is formed on the second frame; and the protruding portion can push the first snap hook towards the first frame.

Furthermore, in at least one embodiment the second snap hook is formed by extending from the first frame, or is fixed to the first frame.

Furthermore, a snap claw is provided on the first snap hook; when the first snap hook is rotated into the first frame and the second frame fixes the first snap hook to the first frame, the protruding portion is inserted between the snap claw and the second snap hook.

Furthermore, in at least one embodiment the second frame further comprises a base plate; and the protruding portion is a bent plate structure extending in a bent form from the base plate.

Furthermore, in at least one embodiment the protruding portion is annular.

Furthermore, in at least one embodiment a through-hole is formed on the base plate; a protuberance is formed on a free end of the protruding portion; and the protuberance is inserted in the through-hole.

Furthermore, in at least one embodiment the first frame comprises a first beam, a second beam, a first side plate and a second side plate; the first beam and the second beam are spaced apart; the first side plate is disposed on a first side of the first beam and the second beam; the second snap hook is disposed on the first side plate; the second side plate is disposed on a second side of the first beam and the second beam, the second side and the first side being two opposite sides of the first frame; the first snap hook is rotatably mounted on the second side plate; the second frame further comprises a first side portion, a second side portion and two connecting portions; the first side portion is disposed on one side of the base plate, and is adjacent to the second side plate; the second side portion is disposed on the other side of the base plate and is disposed opposite to the first side portion; the second side portion is adjacent to the first side plate; the two connecting portions are formed on the first side portion and the second side portion, respectively, and are each rotatably mounted on the first frame by way of a pivot; when the first snap hook rotates into the first frame and the second frame fixes the first snap hook to the first frame, the size of the protruding portion in the direction from the first side portion to the second side portion is equal to the distance between the snap claw and the second snap hook.

Furthermore, in at least one embodiment a snap claw is provided on the first snap hook; the snap claw and the second snap hook each comprise a first insertion piece and a second insertion piece spaced from the first insertion piece; the first insertion piece and the second insertion piece have different sizes.

Furthermore, in at least one embodiment the first insertion piece and the second insertion piece have different widths.

At least one embodiment of the present invention also provides a circuit breaker, comprising a housing and a handle mounted in the housing; a first mounting portion and a second mounting portion are provided on the housing; the circuit breaker further comprises the handle locking device mentioned above; and the protruding portion limits the first snap hook and the second snap hook in the first mounting portion and the second mounting portion corresponding thereto, respectively.

Furthermore, in at least one embodiment the first mounting portion and the second mounting portion each comprise a first mounting hole and a second mounting hole; and the first mounting hole and the second mounting hole have different sizes.

Since, in one embodiment of the present invention, the first snap hook and second snap hook are disposed asymmetrically on the first frame in the handle locking device and the circuit breaker in which the handle locking device is used, accidental mounting of the "OFF" position of the handle locking device in the "ON" position of the circuit breaker during installation by an operator can be avoided, so the current-passing state can be guaranteed, as can the lives of operators during maintenance work, with increased personal safety for staff. In addition, having the first snap hook mounted rotatably on the second side plate enables the handle locking device to be mounted on the circuit breaker or removed therefrom conveniently and quickly. Furthermore, since the protruding portion can push the first snap hook towards the first frame, forced deformation of the snap claw and second snap hook can be prevented, increasing the reliability of the handle locking device.

FIG. 1 shows a schematic diagram of handle locking device 100 in an embodiment of the present invention. As shown in FIG. 1, the handle locking device 100 comprises a first frame 110, a first snap hook 120, a second frame 130 and a crossbar 140. The first snap hook 120 is rotatably mounted on the first frame 110, and can be used to install the first frame 110 in the circuit breaker in which the handle locking device 100 is being used. The second frame 130 is rotatably mounted on the first frame 110 and can fix the first snap hook 120 relative to the first frame 110, as well as being able to lock the handle of the circuit breaker. The crossbar 140 is mounted on the first frame 110, and used to prevent the handle locking device 100 from locking the circuit breaker handle in the "ON" position of the circuit breaker. If the crossbar 140 were to be cut or removed, the handle locking device 100 would be able to lock the handle in the "ON" position of the circuit breaker.

Figure 2:
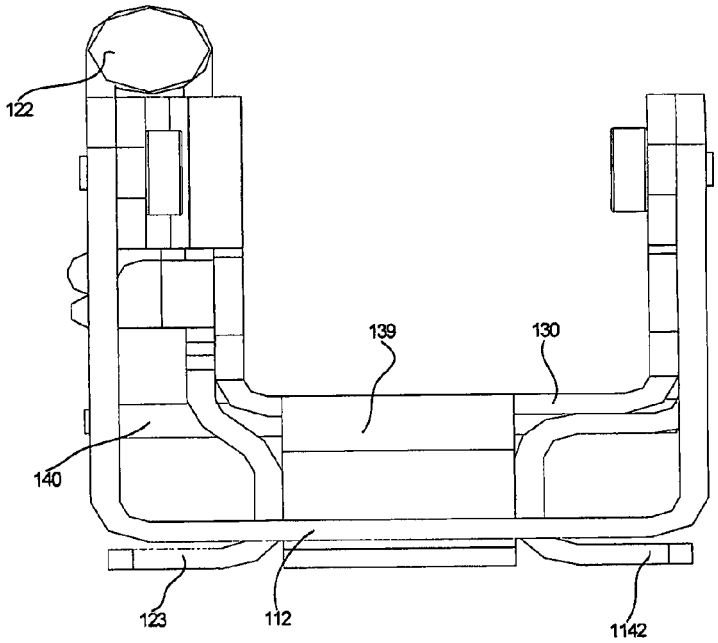
FIG. 2 is a schematic diagram of the handle locking device shown in FIG. 1, viewed from one side.
Figure 3:
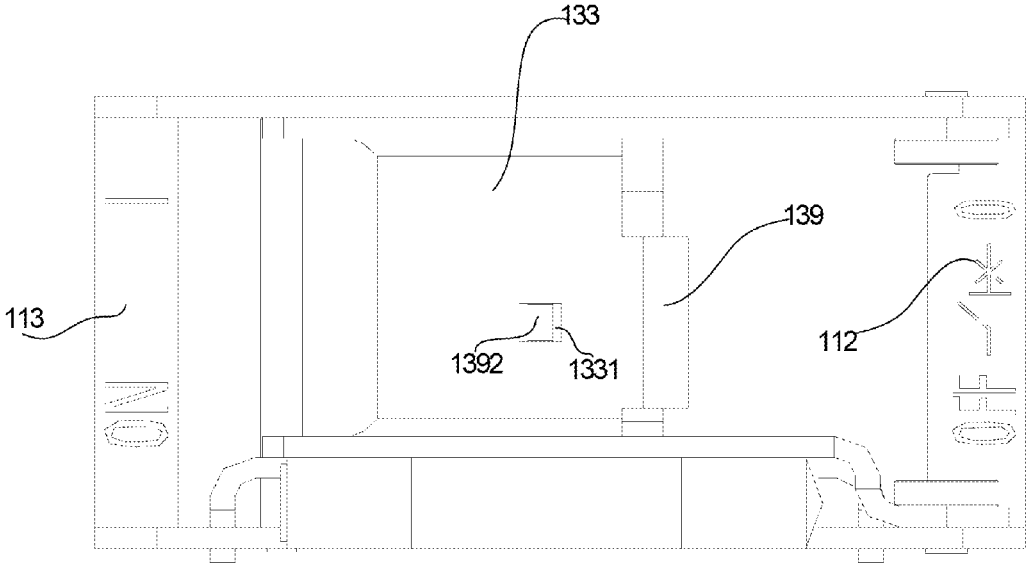
FIG. 3 is a view from above of the handle locking device shown in FIG. 1.

In the examples shown in FIG. 1 and FIG. 2, the first frame 110 comprises a first beam 112, a second beam 113, a first side plate 114 and a second side plate 115.

The first beam 112 and second beam 113 are spaced apart, and substantially parallel. The first beam 112 and second beam 113 can be labeled separately to indicate the operating state of the handle locking device 100; for example, the word "OFF" can be written on the first beam 112.

The first side plate 114 is disposed on a first side of the first beam 112 and second beam 113, e.g. the right-hand side (when the first frame 110 is in the position shown in FIG. 2), and connected to ends of the first beam 112 and second beam 113 separately. In one embodiment, the first side plate 114 is arranged to be substantially perpendicular to the first beam 112 and second beam 113. A second snap hook 1142 is provided on the first side plate 114, for fitting into a socket in the circuit breaker in which the handle locking device 100 is used, and thereby installing the first frame 110 in the circuit breaker in which the handle locking device 100 is used. In one embodiment, the second snap hook 1142 is disposed on the first side plate 114 in a position between the first beam 112 and the second beam 113. The second snap hook 1142 can be formed by extending from the first side plate 114, or be fixed to the first side plate 114 by a bolt, etc. In addition, a mounting hole 1143 may also be provided on the first side plate 114. The mounting hole 1143 is disposed in the first side plate 114 in a position adjacent to the second beam 113, and used for mounting the crossbar 140. A lock hole 118 is provided in the first side plate 114, for fixing the second frame 130 (this will be explained further below).

Figure 4:
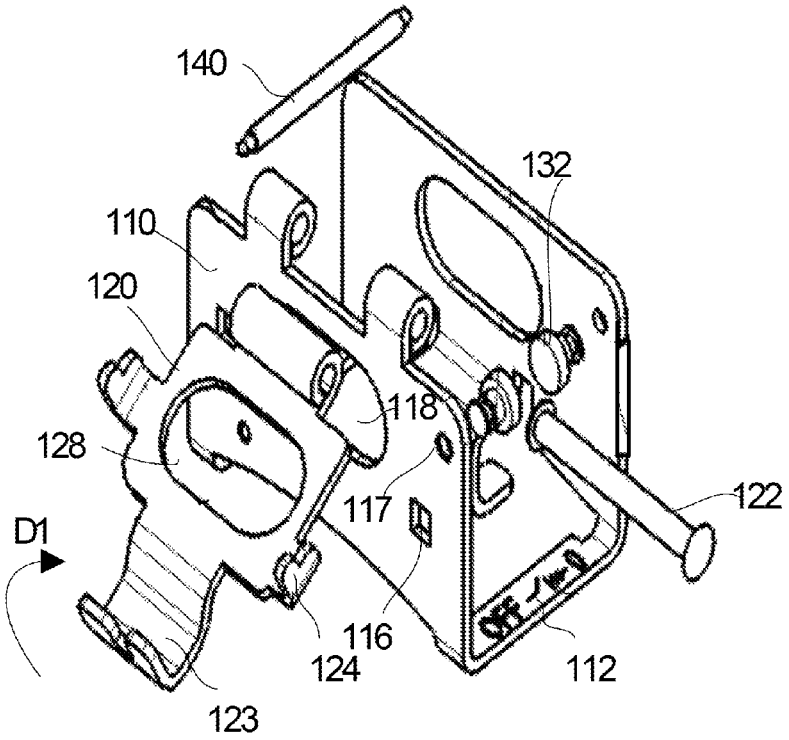
FIG. 4 is an exploded schematic diagram of some of the elements of the handle locking device shown in FIG. 1.
Figure 5:
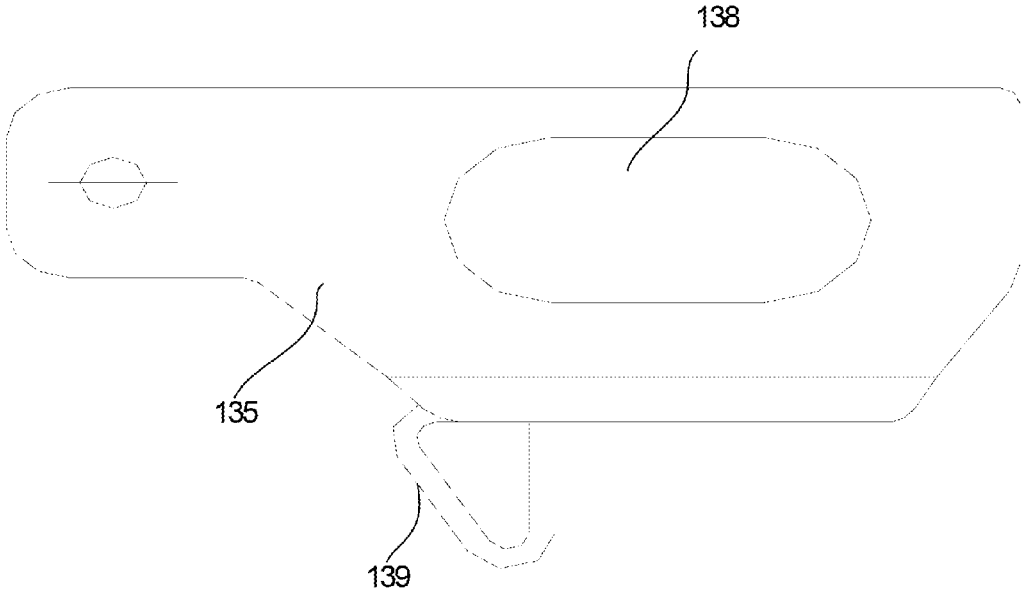
FIG. 5 is a schematic diagram of the second frame of the handle locking device shown in FIG. 1.
Figure 6:
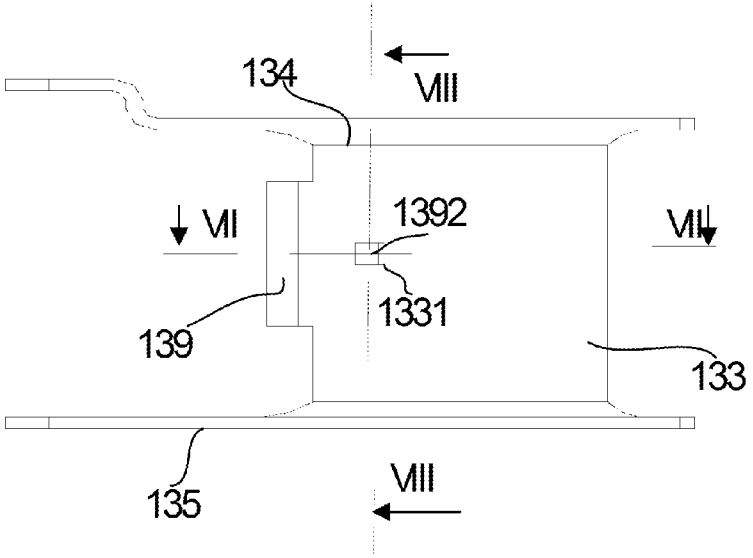
FIG. 6 is a view from above of the second frame shown in FIG. 5.
Figure 7:
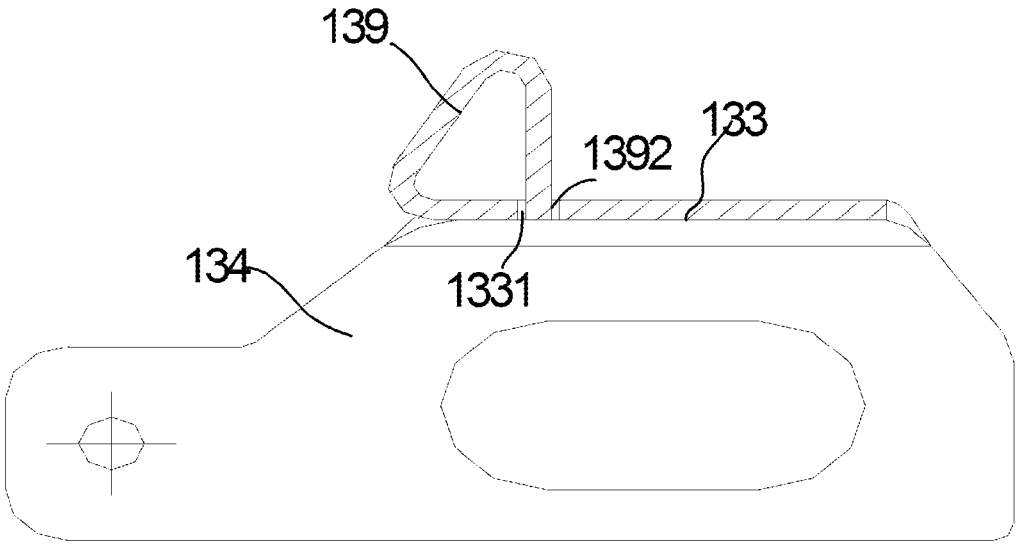
FIG. 7 is a schematic diagram of a section taken along line VII-VII in FIG. 6.
Figure 8:
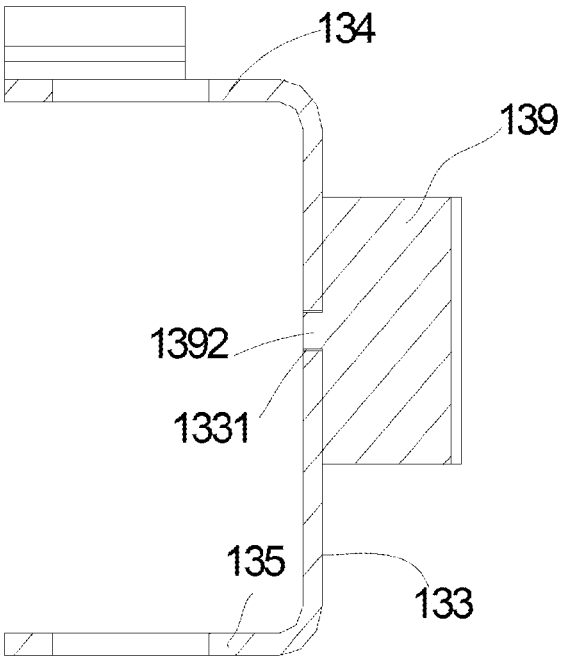
FIG. 8 is a schematic diagram of a section taken along line VIII-VIII in FIG. 6.

The second side plate 115 is disposed on a second side of the first beam 112 and second beam 113, e.g. the left-hand side (when the first frame 110 is in the position shown in FIG. 2), and connected to ends of the first beam 112 and second beam 113 separately. In one embodiment, the second side plate 115 is arranged to be substantially perpendicular to the first beam 112 and second beam 113. As FIG. 4 shows, a lock hole 118, two fixing holes 116 and a mounting hole 117 are provided on the second side plate 115. The lock hole 118 is used for fixing the second frame 130 (this will be explained further below). The two fixing holes 116 are disposed in the second side plate 115 at a distance from each other on the two sides of the lock hole 118, and can be used to fix the first snap hook 120 in place. The mounting hole 117 is disposed in the second side plate 115 in a position adjacent to the second beam 113, and used for mounting the crossbar 140.

The first snap hook 120 is rotatably mounted on the first frame 110. As FIG. 4 shows, a first end of the first snap hook 120 can be rotatably mounted on the second side plate 115 by way of a pivot 122. In one embodiment, the pivot 122 is substantially parallel to the second side plate 115, and the first snap hook 120 rotates relative to the first frame 110 with the pivot 122 as a rotation shaft. For instance, as FIGS. 1 and 4 show, the first snap hook can rotate from the outside of the first frame 110 to the inside of the first frame 110 in a first direction D1, or conversely, from the inside of the first frame 110 to the outside of the first frame 110. A snap claw 123, a lock hole 128 and two locating structures 124 are further provided on the first snap hook 120. The snap claw 123 is formed at a second end of the first snap hook 120, wherein the second end and a first end are two opposite sides of the first snap hook 120. The lock hole 128 is formed in the first snap hook 120 in a position between the first end and second end of the first snap hook 120. The two locating structures 124 are arranged in a one-to-one correspondence with the two fixing holes 116 in the second side plate 115. When the first snap hook 120 rotates to the inside of the first frame 110 and is substantially parallel to the second side plate, the two locating structures 124 can be inserted into the two fixing holes 116 and cooperate therewith so as to achieve preliminary fixing of the first snap hook 120 to the second side plate 115. At the same time, lock hole 128 aligns with lock holes 118, and the snap claw 123 projects from the inside of the first frame 110 to the outside of the first frame 110, for the purpose of fitting into a socket in the circuit breaker in which the handle locking device 100 is used, so as to install the first frame 110 in the circuit breaker in which the handle locking device 100 is used.

Figure 12:
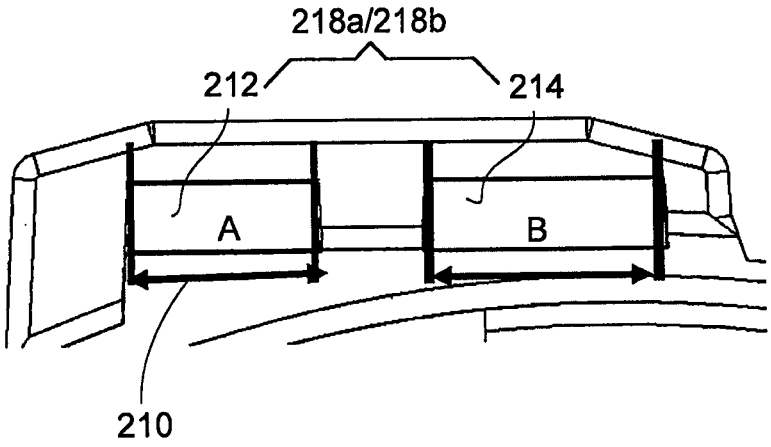
FIG. 12 is a schematic diagram of the first mounting hole and second mounting hole in the housing of the circuit breaker.

In one embodiment, as FIG. 1 shows, the snap claw 123 and second snap hook 1142 each comprise a first insertion piece 182 and a second insertion piece 184. The first insertion piece 182 and second insertion piece 184 are spaced apart, and have different dimensions, e.g. width; for example, the width A of the first insertion piece 182 is less than the width B of the second insertion piece 184. The straight line on which the first insertion piece 182 on the snap claw 123 and the first insertion piece 182 on the second snap hook 1142 lie is substantially parallel to the straight line on which the second insertion piece 184 on the snap claw 123 and the second insertion piece 184 on the second snap hook 1142 lie. In other words, there is no centre symmetry between the first insertion piece 182 and second insertion piece 184 on the snap claw 123 and the first insertion piece 182 and second insertion piece 184 on the second snap hook 1142. As FIG. 12 shows, a first mounting portion 218*a* for mounting the snap claw 123 and a second mounting portion 218*b* for mounting the second snap hook 1142 are provided on a housing 210 of a circuit breaker 200. The first mounting portion 218*a* and second mounting portion 218*b* each comprise a first mounting hole 212 and a second mounting hole 214. The first mounting hole 212 is used for mounting the first insertion piece 182, while the second mounting hole 214 is used for mounting the second insertion piece 184. The width A of the first mounting hole 212 is less than the width B of the second mounting hole 214. The handle locking device 100 can be mounted on the housing 210 by fitting the first insertion piece 182 into the first mounting hole 212 and the second insertion piece 184 into the second mounting hole 214. Since there is no centre symmetry between the first insertion piece 182 and second insertion piece 184 on the snap claw 123 and the first insertion piece 182 and second insertion piece 184 on the second snap hook 1142, if an operator should accidentally place the "OFF" position of the handle locking device 100 against the "ON" position of the circuit breaker during installation, the second insertion piece 184 will not be able to be inserted in the first mounting hole 212 because the width B of the second insertion piece 184 is greater than the width A of the first mounting hole 212; therefore the current-passing state can be guaranteed, as can the lives of operators during maintenance work, with increased personal safety for staff. In addition, an asymmetric structure can also be used for the first snap hook 120 and second snap hook 1142, e.g. with the first insertion piece 182 and second insertion piece 184 on the snap claw 123 and the first insertion piece 182 and second insertion piece 184 on the second snap hook 1142 all having different widths, or one of these having a different width from that of the other three, etc.

Figure 13:
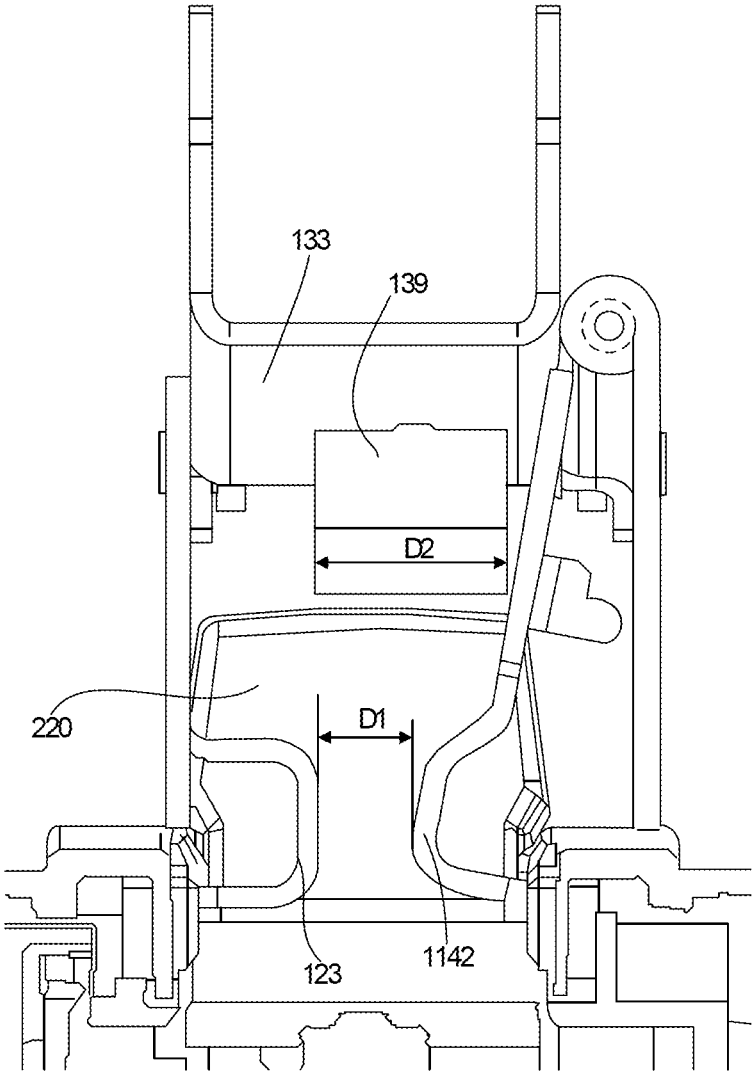
FIG. 13 is a schematic diagram of the handle locking device when it has been mounted wrongly on the circuit breaker.

Furthermore, as FIG. 13 shows, if an operator should accidentally place the "OFF" position of the handle locking device 100 against the "ON" position of the circuit breaker during installation, the second insertion piece 184 will not be able to be inserted in the first mounting hole 212 because the width B of the second insertion piece 184 is greater than the width A of the first mounting hole 212; in this case, the distance D1 between the snap claw 123 and the second snap hook 1142 is less than the width D1 of a protruding portion 139 (which will be described further below) on the second frame 130, which can further prevent wrong mounting of the handle locking device 100 on the circuit breaker 200. Thus the operator can be prevented from mounting the handle locking device 100 on the circuit breaker 200 wrongly by exerting a large force to deform the snap claw 123 and second snap hook 1142; therefore the current-passing state can be further guaranteed, as can the lives of operators during maintenance work, with increased personal safety for staff.

The second frame 130 is rotatably mounted on the first frame 110; for example, as FIG. 1 shows, the second frame 130 can rotate from the outside of the first frame 110 to the inside of the first frame 110 in a second direction D2, or from the inside of the first frame 110 to the outside of the first frame 110. In one embodiment, the first direction D1 is substantially perpendicular to the second direction D2, i.e. a first plane in which the path of rotation of the first snap hook 120 lies is substantially perpendicular to a second plane in which the path of rotation of the second frame 130 lies. As FIGS. 1 and 5-8 show, the second frame 130 comprises a base plate 133, a first side portion 134, a second side portion 135, two connecting portions 136, two lock holes 138 and a protruding portion 139. A through-hole 1331 is formed on the base plate 133. The first side portion 134 is disposed on one side of the base plate 133, and is close to the second side plate 115. The second side portion 135 is disposed on the other side of the base plate 133, opposite the first side portion 134, and is close to the first side plate 114. The two connecting portions 136 are formed on the first side portion 134 and the second side portion 135, respectively, and are each rotatably mounted on the first frame 110 by way of a pivot 132. The mounting positions of the two connecting portions 136 on the first frame 110 are close to the first beam 112. The two lock holes 138 are formed on the first side portion 134 and the second side portion 135, respectively.

The protruding portion 139 is disposed on the base plate 133 in a position between the snap claw 123 and the second snap hook 1142. In one embodiment, the width D2 of the protruding portion 139 in the direction from the first side portion 134 to the second side portion 135 is matched with the distance between the snap claw 123 and the second snap hook 1142 when these two components are correctly mounted on the circuit breaker 200, for example substantially the same. In other words, the width D2 of the protruding portion 139 can limit the snap claw 123 and the second snap hook 1142 in the first mounting portion 218*a* and second mounting portion 218*b* corresponding thereto, respectively. During manipulation of the handle locking device 100 by a user, the circuit breaker 200 will exert a force on the handle locking device 100, but as the protruding portion 139 is sandwiched between the snap claw 123 and second snap hook 1142, forced deformation of the snap claw 123 and second snap hook 1142 can be prevented, improving the reliability of the handle locking device 100.

In one embodiment, the protruding portion 139 can be a bent plate structure; for example, it can extend from the base plate 133 in a bent form and bend back to form an annular structure, and a protuberance 1392 can be formed on a free end of the protruding portion 139. The protuberance 1392 can be inserted in the through-hole 1331 in the base plate 133, to serve a locating function, etc. One end of the crossbar 140 is mounted in the mounting hole 117 of the second side plate 115, while the other end of the crossbar 140 is mounted in the mounting hole 1143 of the first side plate 114. The crossbar 140 can be used to prevent the handle locking device 100 from locking the circuit breaker handle in the "ON" position of the circuit breaker. If the crossbar 140 were to be cut or removed, the handle locking device 100 would be able to lock the handle in the "ON" position of the circuit breaker.

Described above is a particular structure of the handle locking device in an embodiment of the present invention; described briefly below is the method of using the device when it is used in a circuit breaker.

Figure 9:
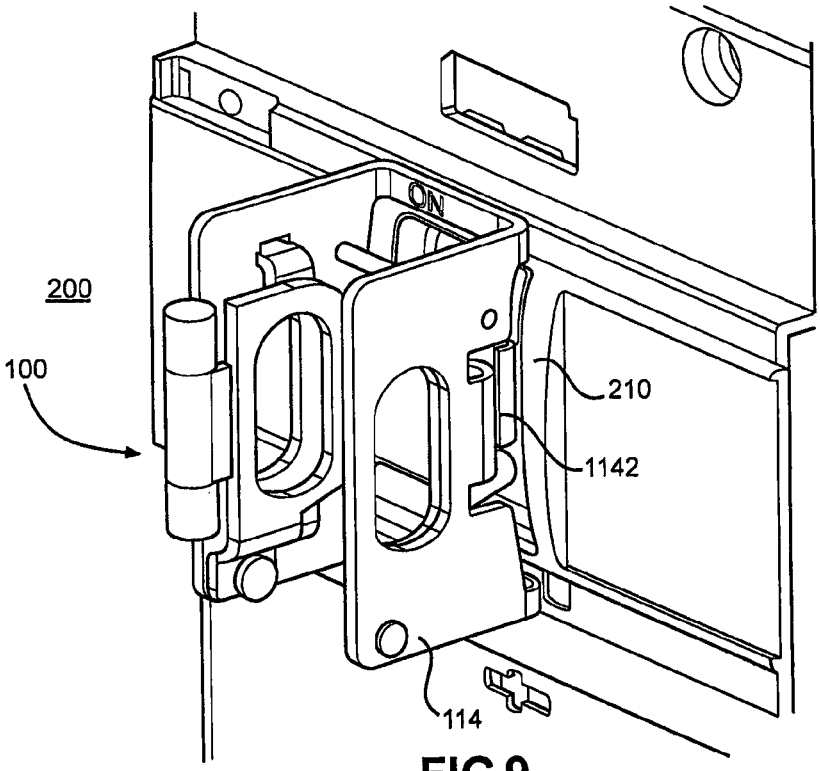
FIG. 9 is a schematic diagram of the handle locking device shown in FIG. 1 when it is applied to a circuit breaker.
Figure 10:
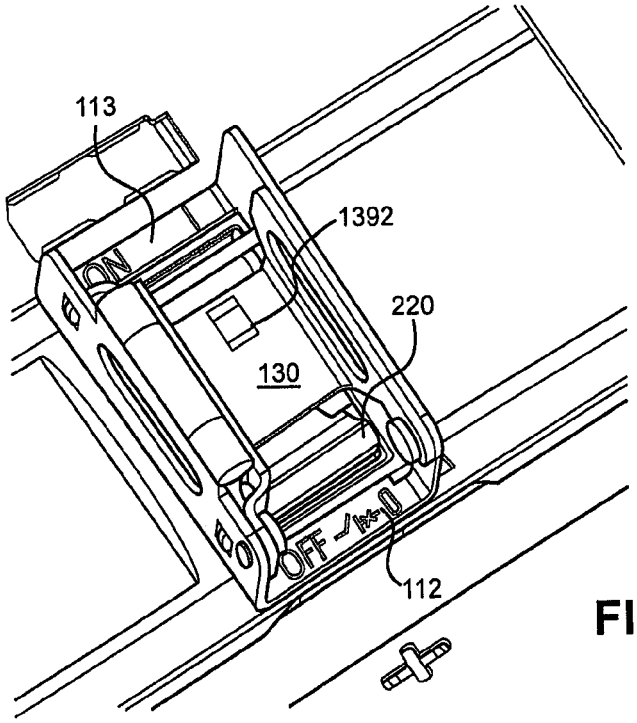
FIG. 10 is a schematic diagram of the handle locking device shown in FIG. 1 when it has locked a handle of the circuit breaker in the OFF position.
Figure 11:
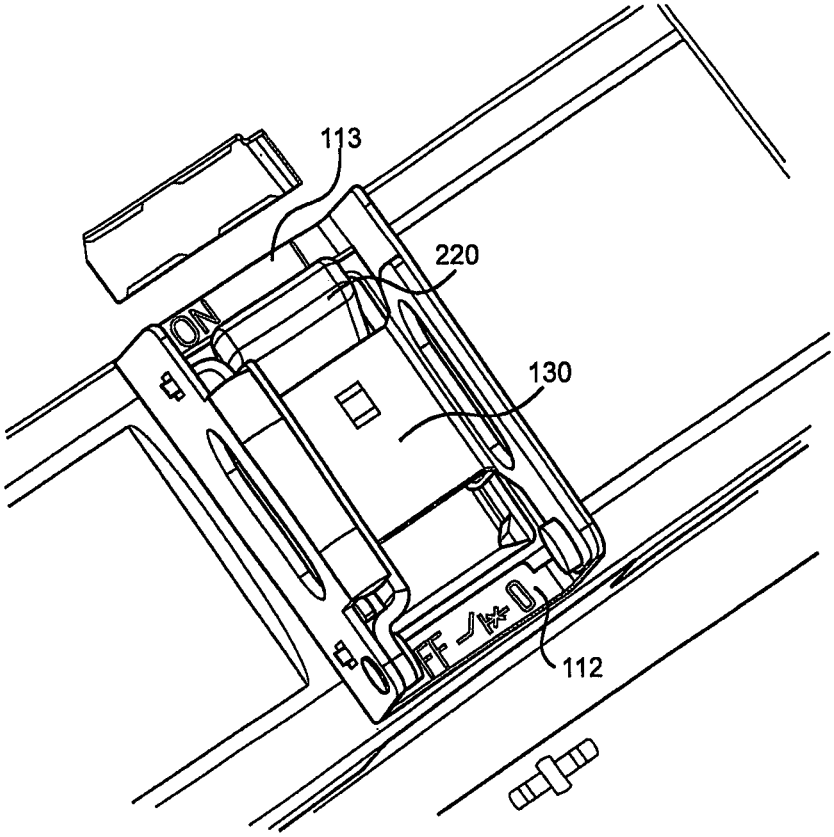
FIG. 11 is a schematic diagram of the handle locking device shown in FIG. 1 when it has locked a handle of the circuit breaker in the ON position.

FIG. 9 is a schematic diagram of the handle locking device 100 shown in FIG. 1 when it is applied to the circuit breaker 200. FIG. 10 is a schematic diagram of the handle locking device 100 shown in FIG. 1 when it has locked a handle 220 of the circuit breaker 200 in the OFF position. FIG. 11 is a schematic diagram of the handle locking device 100 shown in FIG. 1 when it has locked a handle 220 of the circuit breaker 200 in the ON position. As shown in FIGS. 9 to 11, the handle locking device 100 is placed on the housing 210 of the circuit breaker 200, such that the second snap hook 1142 on the first side plate 114 is inserted in a socket in the housing 210 of the circuit breaker 200, and such that a handle 220 of the circuit breaker 200 is positioned between the first beam 112 and second beam 113. Next, the first snap hook 120 is rotated in the first direction D1 until the two locating structures 124 on the first snap hook 120 are inserted in the two fixing holes 116 and cooperate therewith so as to achieve preliminary fixing of the first snap hook 120 on the second side plate 115. At this point, lock hole 128 is aligned with lock holes 118, while the snap claw 123 projects from the inside of the first frame 110 to the outside of the first frame 110 and fits into a socket in the housing 210 of the circuit breaker 200. In this way, the first frame 110 can be mounted on the circuit breaker 200 by way of the cooperation between the first snap hook 120/second snap hook 1142 and the sockets in the circuit breaker 200. Next, the second frame 130 is rotated in the second direction D2 until the base plate 133 of the second frame 130 is propped on the snap claw 123 and second snap hook 1142. At this point, the first side portion 134 is fitted to the second side plate 115, the second side portion 135 is fitted to the first side portion 134, and the protruding portion 139 is sandwiched between the snap claw 123 and the second snap hook 1142 so as to fix the first snap hook 120 to the second side plate 115. At the same time, lock holes 138, lock hole 128 and lock holes 118 are aligned with each other, so rotation of the second frame 130 can be prevented by inserting a locking structure into the lock holes 138, lock hole 128 and lock holes 118.

As stated above, since, in one embodiment of the present invention, the first snap hook 120 and second snap hook 1142 are disposed asymmetrically on the first frame 110 in the handle locking device 100 and the circuit breaker 200 in which the handle locking device 100 is used, accidental mounting of the "OFF" position of the handle locking device 100 in the "ON" position of the circuit breaker during installation by an operator can be avoided, so the current-passing state can be guaranteed, as can the lives of operators during maintenance work, with increased personal safety for staff. In addition, having the first snap hook 120 mounted rotatably on the second side plate 115 enables the handle locking device 100 to be mounted on the circuit breaker or removed therefrom conveniently and quickly. Furthermore, since the protruding portion 139 is sandwiched between the snap claw 123 and second snap hook 1142, forced deformation of the snap claw 123 and second snap hook 1142 can be prevented, increasing the reliability of the handle locking device 100. Moreover, if the handle 220 in the circuit breaker 200 is in the handle position occupied when the contacts have become welded together (positive off), the handle 220 will be closer to the second beam 113 (the ON position) than to the first beam 112 (the OFF position), and the handle 220 can obstruct the mounting of the handle locking device 100 in the circuit breaker 200, so that the snap claw 123 and second snap hook 1142 cannot be inserted into the corresponding first mounting portion 218*a* and second mounting portion 218*b*. As a result, the distance D1 between the snap claw 123 and the second snap hook 1142 is less than the width D2 of the protruding portion 139 on the second frame 130, so wrong mounting of the handle locking device 100 on the circuit breaker 200 can be prevented. Thus the operator can be prevented from mounting the handle locking device 100 on the circuit breaker 200 wrongly by exerting a large force to deform the snap claw 123 and second snap hook 1142; therefore the current-passing state can be further guaranteed, as can the lives of operators during maintenance work, with increased personal safety for staff.

In summary, disclosed in at least one embodiment of the present invention is a handle locking device, comprising a first frame, a first snap hook and a second frame. A second snap hook is provided on the first frame; the first snap hook is rotatably mounted on the first frame; the second frame is rotatably mounted on the first frame and can fix the first snap hook to the first frame; a protruding portion is formed on the second frame; and the protruding portion can push the first snap hook towards the first frame. By having the first snap hook and second snap hook disposed asymmetrically on the first frame, accidental mounting of the "OFF" position of the handle locking device in the "ON" position of the circuit breaker during installation by an operator can be avoided, so the current-passing state can be guaranteed, as can the lives of operators during maintenance work, with increased personal safety for staff. Moreover, since the protruding portion can push the first snap hook towards the first frame, forced deformation of the snap claw and second snap hook can be prevented, increasing the reliability of the handle locking device.

The above embodiments are merely preferred embodiments of the present invention, and are not intended to limit it. Any amendments, equivalent substitutions or improvements made without departing from the spirit and principles of the present invention should be included in the scope of protection thereof.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Although the invention has been illustrated and described in detail on the basis of the preferred example embodiment, the invention is not limited by the disclosed examples and other variations can be derived herefrom by the person skilled in the art, without departing from the scope of protection of the invention.

The labels used in the accompanying drawings include:

100 handle locking device
110 first frame
112 first beam
113 second beam
114 first side plate
1142 second snap hook
1143 mounting hole
115 second side plate
116 fixing hole
117 mounting hole
118 lock hole
120 first snap hook
122 pivot
123 snap claw
124 locating structure
128 lock hole
130 second frame
132 pivot
133 base plate
1331 through-hole
134 first side portion
135 second side portion
136 connecting portion
138 lock hole
139 protruding portion
1392 protuberance
140 crossbar
182 first insertion piece
184 second insertion piece
200 circuit breaker
210 housing
212 first mounting hole
214 second mounting hole
218*a* first mounting hole
218*b* second mounting hole
220 handle
D1 first direction
D2 second direction

What is claimed is:

1. A handle locking device, comprising:
a first frame;
a first snap hook, rotatably mounted on the first frame;
a second frame, rotatably mounted on the first frame and configured to fix the first snap hook to the first frame;
a second snap hook, provided on the first frame; and
a protruding portion, formed on the second frame and configured to push the first snap hook towards the first frame, a snap claw, provided on the first snap hook, wherein when the first snap hook is rotated into the first frame and the second frame fixes the first snap hook to the first frame, the protruding portion is inserted between the snap claw and the second snap hook.

2. The handle locking device of claim 1, wherein the second snap hook is formed by extending from the first frame, or is fixed to the first frame.

3. A circuit breaker, comprising:
a housing;
a handle mounted in the housing, a first mounting portion and a second mounting portion being provided on the housing; and
the handle locking device of claim 2, the protruding portion being configured to limit the first snap hook and the second snap hook in the first mounting portion and the second mounting portion corresponding thereto, respectively.

4. The circuit breaker of claim 3, wherein the first mounting portion and the second mounting portion each comprise a first mounting hole and a second mounting hole; and wherein the first mounting hole and the second mounting hole have different sizes.

5. The handle locking device of claim 1, wherein the second frame further comprises a base plate; and wherein the protruding portion is a bent plate structure extending in a bent form from the base plate.

6. The handle locking device of claim 5, wherein the protruding portion is annular.

7. The handle locking device of claim 6, wherein a through-hole is formed on the base plate; a protuberance is formed on a free end of the protruding portion; and the protuberance is insertable in the through-hole.

8. The handle locking device of claim 5, wherein
the first frame comprises a first beam, a second beam, a first side plate and a second side plate, the first beam and the second beam being spaced apart;
the first side plate is disposed on a first side of the first beam and the second beam, the second snap hook is disposed on the first side plate, the second side plate is disposed on a second side of the first beam and the second beam, the second side and the first side being two opposite sides of the first frame, and the first snap hook is rotatably mounted on the second side plate;
the second frame further comprises a first side portion, a second side portion and two connecting portions;
the first side portion is disposed on one side of the base plate and is adjacent to the second side plate, the second side portion is disposed on the other side of the base plate and is disposed opposite to the first side portion, the second side portion is adjacent to the first side plate, the two connecting portions are formed on the first side portion and the second side portion, respectively, and are each rotatably mounted on the first frame by way of a pivot; and when the first snap hook rotates into the first frame and the second frame fixes the first snap hook to the first frame, the size of the protruding portion in the direction from the first side portion to the second side portion is equal to the distance between the snap claw and the second snap hook.

9. A circuit breaker, comprising:

a housing;

a handle mounted in the housing, a first mounting portion and a second mounting portion being provided on the housing; and the handle locking device of claim 8, the protruding portion being configured to limit the first snap hook and the second snap hook in the first mounting portion and the second mounting portion corresponding thereto, respectively.

10. The circuit breaker of claim 9, wherein the first mounting portion and the second mounting portion each comprise a first mounting hole and a second mounting hole; and wherein the first mounting hole and the second mounting hole have different sizes.

11. A circuit breaker, comprising:

a housing;

a handle mounted in the housing, a first mounting portion and a second mounting portion being provided on the housing; and the handle locking device of claim 4, the protruding portion being configured to limit the first snap hook and the second snap hook in the first mounting portion and the second mounting portion corresponding thereto, respectively.

12. The circuit breaker of claim 11, wherein the first mounting portion and the second mounting portion each comprise a first mounting hole and a second mounting hole; and wherein the first mounting hole and the second mounting hole have different sizes.

13. The handle locking device of claim 1, wherein the snap claw is provided on the first snap hook; the snap claw and the second snap hook each comprise a first insertion piece and a second insertion piece spaced from the first insertion piece; and the first insertion piece and the second insertion piece have different sizes.

14. The handle locking device of claim 13, wherein the first insertion piece and the second insertion piece have different widths.

15. A circuit breaker, comprising:

a housing;

a handle mounted in the housing, a first mounting portion and a second mounting portion being provided on the housing; and the handle locking device of claim 1, the protruding portion being configured to limit the first snap hook and the second snap hook in the first mounting portion and the second mounting portion corresponding thereto, respectively.

16. The circuit breaker of claim 15, wherein the first mounting portion and the second mounting portion each comprise a first mounting hole and a second mounting hole; and wherein the first mounting hole and the second mounting hole have different sizes.

* * * * *